US011136806B2

(12) United States Patent
Kuramochi

(10) Patent No.: US 11,136,806 B2
(45) Date of Patent: Oct. 5, 2021

(54) OPENING AND CLOSING DEVICE FOR OPENING AND CLOSING BODY, AND VARIOUS OPENED AND CLOSED BODIES HAVING THE SAME

(71) Applicant: KEM HONGKONG LIMITED, Kowloon (HK)

(72) Inventor: Ryuta Kuramochi, Kanagawa (JP)

(73) Assignee: KEM HONGKONG LIMITED, Kowloon (HK)

( * ) Notice: Subject to any disclaimer, the term of this patent is extended or adjusted under 35 U.S.C. 154(b) by 0 days.

(21) Appl. No.: 16/008,600

(22) Filed: Jun. 14, 2018

(65) Prior Publication Data

US 2018/0363349 A1 Dec. 20, 2018

(30) Foreign Application Priority Data

Jun. 20, 2017 (JP) ..... JP2017-120800

(51) Int. Cl.

| | |
|---|---|
| ***E05F 3/10*** | (2006.01) |
| ***E05D 3/12*** | (2006.01) |
| ***E05D 3/14*** | (2006.01) |
| ***E05F 3/22*** | (2006.01) |
| ***E05F 1/08*** | (2006.01) |

(Continued)

(52) U.S. Cl.

CPC ..... *E05F 3/104* (2013.01); *E05D 3/12* (2013.01); *E05D 3/14* (2013.01); *E05F 1/08* (2013.01); *E05F 1/1261* (2013.01); *E05F 3/16* (2013.01); *E05F 3/221* (2013.01); *E05F 5/02* (2013.01); *E05Y 2201/21* (2013.01); *E05Y 2201/25* (2013.01); *E05Y 2201/256* (2013.01); *E05Y 2201/264* (2013.01); *E05Y 2201/492* (2013.01); *E05Y 2201/624* (2013.01);

(Continued)

(58) Field of Classification Search

CPC ..... E05F 3/00; E05F 3/04; E05F 3/10; E05F 3/104; E05F 3/12; E05F 3/221; E05F 3/16; E05F 1/12; E05F 1/1261; E05D 3/14; E05D 3/12

USPC ..... 16/344, 277, 286, 289, 284, 302, 312, 16/315, 321, 325, 343

See application file for complete search history.

(56) References Cited

U.S. PATENT DOCUMENTS 5,465,557 A * 11/1995 Harte ..... B65B 31/02 16/289
6,684,456 B2 * 2/2004 Lee ..... E05D 11/1064 16/286

(Continued)

FOREIGN PATENT DOCUMENTS

| | | | |
|---|---|---|---|
| JP | 2009-58790 | A | 3/2009 |
| JP | 2018-71223 | A | 5/2018 |
| WO | 2011/129154 | A1 | 10/2011 |

*Primary Examiner* — Emily M Morgan
(74) *Attorney, Agent, or Firm* — Notaro, Michalos & Zaccaria P.C.

(57) ABSTRACT

To provide an opening and closing device for opening and closing body having a rotation torque controlling module and a torque peak adjusting module, solution was sought by an opened and closed body and the opening and closing body which comprises an attaching part, an opening and closing part rotatably attached to the attaching part via a hinge shaft, a rotation torque controlling module for controlling a rotation torque of the opening and closing part, a torque peak adjusting module for adjusting a torque peak of the opening and closing part at the time of its opening and closing movement.

3 Claims, 17 Drawing Sheets

(51) Int. Cl.
*E05F 3/16* (2006.01)
*E05F 1/12* (2006.01)
*E05F 5/02* (2006.01)

(52) U.S. Cl.
CPC ..... *E05Y 2201/638* (2013.01); *E05Y 2600/12* (2013.01); *E05Y 2900/606* (2013.01); *E05Y 2900/608* (2013.01)

(56) References Cited

U.S. PATENT DOCUMENTS 7,374,137 B2 * 5/2008 Staney ..... F16M 11/10 248/122.1
7,418,766 B2 * 9/2008 Nelson ..... E05D 11/1007 16/239
7,841,049 B2 * 11/2010 Wang ..... A47B 21/0314 16/238
8,813,311 B2 * 8/2014 Li ..... E05D 3/06 16/286
8,973,218 B2 * 3/2015 Yabukoshi ..... E05F 1/1261 16/281
2002/0124738 A1 * 9/2002 Lee ..... A23L 3/001 99/468
2003/0000955 A1 * 1/2003 Lee ..... A23B 7/0425 220/830
2009/0188078 A1 * 7/2009 Choi ..... H04N 1/00519 16/286
2011/0317338 A1 * 12/2011 Chen ..... H05K 5/0226 361/679.01
2012/0117755 A1 * 5/2012 Walhorn ..... E05F 3/104 16/66

* cited by examiner 3
8b
8d
10d
5h
19
B
25c
10
9a
A
11
13
4
8i
5a
12b
12
17b
17a
A2
8
B1
8a
5
5b
25
26
17
2
9
8c
10c
10e
A1
5d
14
11c
5e
20
5g
15c
15b
15
11b
12a 3
8b
8d
19
22
9a
5i
25c
B
10
16b
11
13
12
4
8i
8
B1
8a
5
5b
25
23
24
17
2
21
9
8c
10f
A3
5d
16a
16
11e
5e
20
5g
16c 3
8b
8d
8
4
5a
5b
5
19
5
8h
5b
26
2
9
8c
B
5g
5d
5e
18
5c
20

OPENING AND CLOSING DEVICE FOR OPENING AND CLOSING BODY, AND VARIOUS OPENED AND CLOSED BODIES HAVING THE SAME

This application claims priority from Japanese Patent Application No. 2017-120800, filed Jun. 20, 2017, the entire disclosure of which is incorporated herein by reference.

FIELD OF THE INVENTION

The invention relates to an opening and closing device for opening and closing member, wherein the opening and closing member includes a door body and a document cover, and it is attached to an opened and closed cabinet such as various sorts of cabinets, copying machines and printers, so as to be openable and closable in upward and downward direction; as well as to various opened and closed bodies, each having such an opening and closing device for opening and closing member.

BACKGROUND ART

Conventionally, it is in general preferable for an opening and closing device for opening and closing member to have a function to enable the opening and closing member to stably stop and maintain its state, in which it is opened upward relative to any of various opened and closed bodies. As conventional opening and closing device for opening and closing member, the one described in Re-Publication of PCT International Application in Japan No. 2011-129154 is known. The opening and closing device for opening and closing member described in Re-Publication of PCT International Application in Japan No. 2011-129154 is attached to both inner lateral surfaces, and draws out arms or stays of its interior to support the opening and closing member. Many other opening and closing devices for opening and closing member of this sort have a similar structure.

The opening and closing device for opening and closing member described in Re-Publication of PCT International Application in Japan No. 2011-129154 has a problem that the opening and closing device itself protrudes from both sides of an opened and closed cabinet, and that it has an arm and a stay which are extended and retracted when the opened and closed cabinet is opened and closed, so that such elements are a hindrance to stored goods in the opened and closed cabinet, wherein the goods are stored and taken out; further there is another problem that the opening and closing device does not have an adequate function to stably stop and hold the opening and closing member at a predetermined opening angle of the opening and closing member. Furthermore, the opening and closing device has redundant components, such as an additional elastic member which is used as buffering mechanism for mitigating an impact at the time of closing the opened and closed cabinet. Still further, the one comprising an opening and closing torque controlling mechanism of the opened and closed cabinet is known according to JP Laid-Open Patent Application No. 2009-58790, but it is not provided with torque peak adjusting mechanism.

Therefore, to solve the above-mentioned problem, the Applicant proposed an opening and closing device for opening and closing member provided between an opened and closed cabinet and the opening and closing member for openably and closably coupling the opening and closing member to the opened and closed cabinet, wherein the opening and closing device comprises an external bracket having at least a back plate portion and both side plate portions bent from the back plate portion, wherein the external bracket is attached to the opened and closed cabinet; an opening and closing member having at least a back plate portion to which the opening and closing member is attached and both side plate portions bent from the back plate portion, wherein the both side plate portions are rotatably attached to the both side plate portions of the external bracket via a hinge shaft, a pressure receiving member attached to a position for rotating with the hinge shaft as a fulcrum between the both side plate portions of the opening and closing member, a cam slider in contact with the pressure receiving member, wherein it is provided so as to be slidable in the external bracket, an urging mechanism provided in the external bracket for pressurizing the cam slider toward the pressure receiving member, an engaging mechanism for releasably engaging with an engaging portion provided on the cam slider, depending on a slide position of the cam slider which varies depending on a rotation angle of the opening and closing member as accompanied with an opening and closing movement of the opening and closing member, and an elastic force adjusting mechanism for adjusting an elastic force of the urging mechanism; additionally, the Applicant also proposed various opened and closed bodies comprising such an opening and closing device (JP Patent Application No. 2016-213435).

The opening and closing device for opening and closing member according to this earlier application does adjust a rotation torque of the opening and closing member using the elastic force adjusting mechanism, but does not have a structure for enabling the device to adjust a torque peak of the opening and closing member. Needs to optionally change a torque peak of the opening and closing member within a predetermined range are fully recognized, mainly in terms of convenience and versatility. Still further, it is also a technical problem to enhance a function of stably holding the opening and closing member at a closed state at 0 degree and at a fully opened state relative to the opened and closed cabinet, with no use of stay and arm.

SUMMARY OF THE INVENTION

Therefore, it is an object of the invention to provide an opening and closing device for opening and closing member for attaching an opening and closing member to an opened and closed cabinet, such that the former can open and close relative to the latter, wherein the opening and closing device is further featured with a function of changing a torque peak of the opening and closing member and of stably holding the opening and closing member, as well as various opened and closed bodies comprising such an opening and closing device for opening and closing member.

To solve the above-mentioned problem, the invention according to the first aspect is an opening and closing device for opening and closing member provided between an opened and closed cabinet and the opening and closing member for coupling the opening and closing member to the opened and closed cabinet so as to be openable and closable in upward and downward direction, which is characterized in that it comprises an attaching member having at least a back plate and both side plates bent from the back plate and attached to the opened and closed cabinet; an opening and closing member having at least an attaching plate to which the opening and closing member is attached and both side plates bent from the attaching plate, wherein the opening and closing member is rotatably attached to the attaching member via a hinge shaft; a rotation torque controlling mechanism for controlling a rotation torque of the opening and closing member, a torque peak adjusting mechanism for adjusting a torque peak of the opening and closing member at the time of its opening and closing movement; that the rotation torque controlling mechanism comprises a rotation member attached to the hinge shaft in order to rotate together with the opening and closing member, and a slider provided on the attaching member side and slidably urged by an elastic member toward the rotation member; and that the torque peak adjusting mechanism comprises a link arm, wherein its one end is coupled to the slider side via a second link shaft, and its other end is rotatably attached to the opening and closing member side via a first link shaft rotatably attached with a coupling position on the slider side as a fulcrum, and a position adjusting mechanism provided on the opening and closing member side and capable of adjusting a rotation starting position of the link arm.

Still further, the invention according to the second aspect is characterized in that the rotation torque controlling mechanism comprises a locking mechanism capable of locking the opening and closing member at a predetermined opening and closing angle, wherein the locking mechanism comprises a rotation member attached to the hinge shaft so as to be rotatable together with the opening and closing member, and a locking member provided on the attaching member side so as to be slidable to a rotation member side and to engage with concave portions provided on the rotation member at a predetermined rotation angle of the opening and closing member.

Still further, the invention according to the third aspect of the invention is characterized in that a rotation torque controlling mechanism comprises on a slider side a rotation torque adjusting mechanism capable of adjusting a rotation torque of an opening and closing member.

Still further, the invention according to the fourth aspect of the invention is characterized in that the rotation torque controlling mechanism comprising a buffering mechanism between a slider and a rotation member, said buffering mechanism being composed of a fluid damper for bringing a tip of a piston rod into a pressurized contact with a second cam portions provided on said rotation member, starting from a predetermined rotation angle of said opening and closing member in a closing direction.

Still further, the invention according to the fifth aspect of the invention is characterized in that the position adjusting mechanism of the torque peak adjusting mechanism comprising a first link member, wherein its one end portion arranged between both side plates of an opening and closing member is attached to the opening and closing member so as to be slidable in a back and forth direction, and its other end portion is coupled to said first link shaft, and a second link member, its one end portion is coupled to said first link shaft, and its other end portion is coupled to the hinge shaft, and a adjusting member attached to the opening and closing member and screwed onto the first link member.

Still further, the invention according to the fifth aspect of the invention is an opened and closed cabinet of various sorts equipped with the opening and closing device for opening and closing member according to one of the above-mentioned aspects.

Since the invention is constructed as described in the foregoing, an opening and closing device for opening and closing member does not project into an opened and closed cabinet, so that it is not a hindrance to stored goods which go inside and come out of the opened and closed cabinet, and that at the time of an opening and closing operation, a rotation torque controlling mechanism makes it possible to smoothly open the opening and closing member without giving a feel of its own weight; still further, the invention prevents the opening and closing member from suddenly falling during its closing operation to ensure an enhanced operability, and if it uses a locking mechanism, it enables to maintain a stable holding state at the closed and fully opened state, and if it uses a fluid damper, it enables to absorb a shock in order to prevent the opening and closing member from suddenly falling from its predetermined closing angle for closing. Still further, if it uses an elastic force adjusting mechanism, it enables to adjust an opening and closing torque of an opened and closed cabinet, and if it uses a torque peak adjusting mechanism, it enables to adjust a torque peak of an opening and closing member, so that it is possible to provide a more convenient opening and closing device for opening and closing member.

EMBODIMENTS

Figure 1:
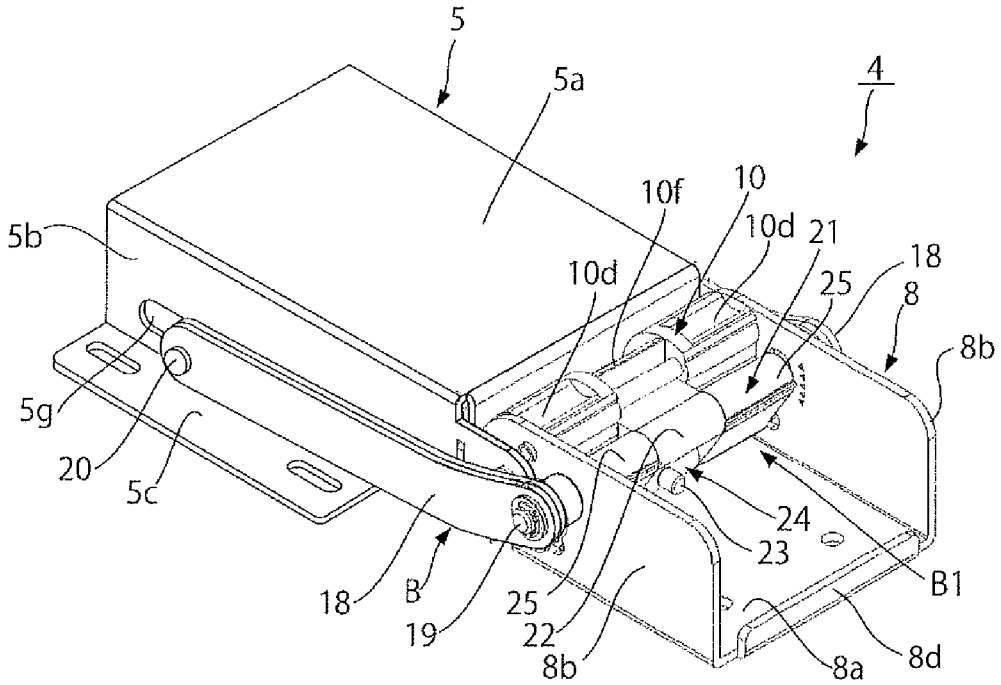
FIG. 1 shows a perspective view of an opening and closing device for opening and closing member according to the invention.
Figure 2:
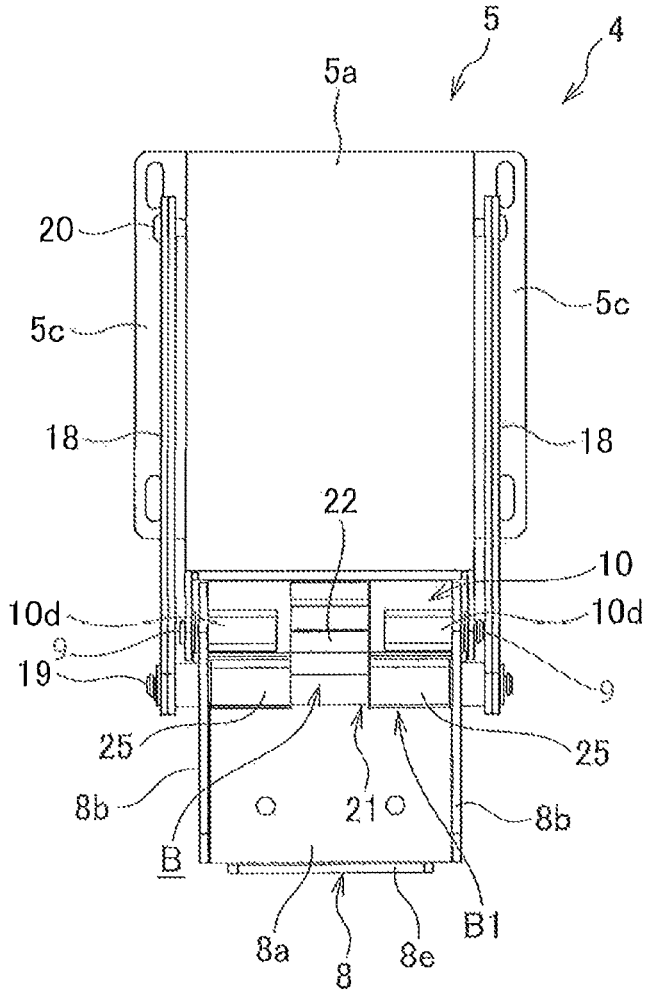
FIG. 2 shows a plan view of an opening and closing device for opening and closing member according to the invention.

In the following, a preferable embodiment of the invention as used for a cabinet for furniture, etc. is described; however, as stated above, an opening and closing device for opening and closing member according to the invention is not limited to the cabinet for furniture, etc., but also applicable to opened and closed bodies such as cabinets of other devices of various sorts and others (e.g. copying machine, (multifunction) printer, etc.), as attached to such opened and closed bodies.

FIGS. 1 to 11 show an embodiment of an opening and closing device 4 for opening and closing member according to the invention. According to the drawings, an opening and closing device 4 for opening and closing member according to the invention comprises an attaching member 5 attached to a cabinet main body (not shown; being opened and closed cabinet), an opening and closing member 8 rotatably attached to the attaching member 5 via a hinge shaft 9, a rotation member 10 through which the hinge shaft 9 passes, so that it is provided so as to be rotatable together with the opening and closing member 8, a rotation torque controlling mechanism A of the opening and closing member 8 provided in the attaching member 5 in contact with the rotation member 10, and a torque peak adjusting mechanism B predominantly provided on the opening and closing member 8 side.

An attaching member 5 according to the embodiment is made up by pressing a metal plate such as SUS; it comprises a back plate 5*a*, both side plates 5*b*, 5*b* bent from the back plate 5*a*, attaching plates 5*c*, 5*c* bent outward from the both side plates 5*b*, 5*b*, a front plate 5*d* bent downward from the back plate 5*a*, and a bottom plate 5*e* bent to the rear from the front plate 5*d*; first hinge shaft coupling holes 5*f*, 5*f* are provided to the front on the both side plates 5*b*, 5*b*, while guide oblong holes 5*g*, 5*g* for passing a second link arm are provided to the rear; the attaching member is therefore attached to a main body of an opened and closed cabinet, etc. via attaching screws not shown.

An opening and closing member 8 according to the embodiment is also made up by pressing a metal plate such as SUS; it comprises an attaching plate 8*a*, both side plates 8*b*, 8*b* erected from the attaching plate 8*a*, and in addition, a rear plate 8*c* bent upward from a rear end portion side of the attaching plate 8*a*, a front plate 8*d* erected from a front side of the attaching plate 8*a*; second hinge shaft coupling holes 8*e*, 8*e* for passing a hinge shaft 9 on rear end portion sides to couple it to both side plates 5*b*, 5*b* of an attaching member 5 are provided on respective rear end portion sides of the both side plates 8*b*, 8*b*. Close to these second hinge shaft coupling holes 8*e*, 8*e*, attaching holes 8*f*, 8*f* for passing a first fixing pin 9*a* for fixing a rotation member 10 are provided, and adjacent to these attaching holes 8*f*, 8*f*, guide long holes 8*g*, 8*g* for passing a first link shaft 19 of a torque adjusting mechanism B to be described below in upward and downward direction are provided. Under both side plates 8*b*, 8*b*, guide oblong holes 8*h*, 8*h* also for a first link member 21 of a torque adjusting mechanism B are provided. Still further, angle marks 8*i*, 8*i* (which can be also scales) for adjusting torque peak angles are provided inside guide oblong holes 8*g*, 8*g* provided on both side plates 8*b*, 8*b* of an opening and closing member 8; the opening and closing member is structured so as to be rotatably coupled to an attaching member 5 by a hinge shaft 9 made of a metal such as SUS passing through first hinge shaft coupling holes 5*f*, 5*f* of the attaching member 5 as well as through second hinge shaft coupling holes 8*e*, 8*e*, wherein its attaching plate 8*a* is attached to an opened and closed cabinet, such as the one not shown herein.

Figure 7A:
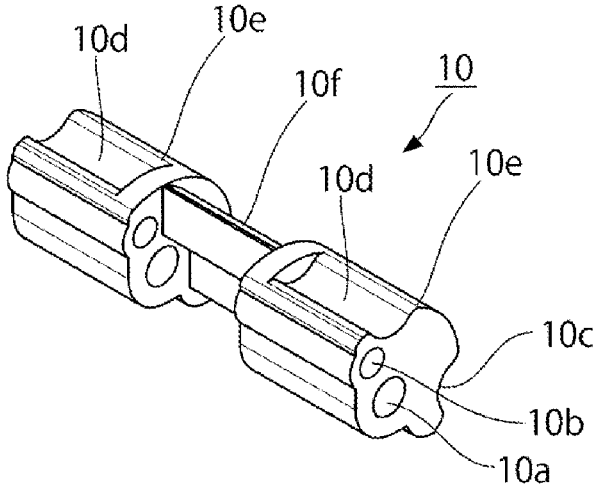
FIGS. 7A to 7C show a rotation member of an opening and closing device for opening and closing member according to the invention, FIG. 7A being its perspective view, as is seen from front, FIG. 7B—its perspective view, as is seen from backward, FIG. 7C—a longitudinal section of its central portion.
Figure 7B:
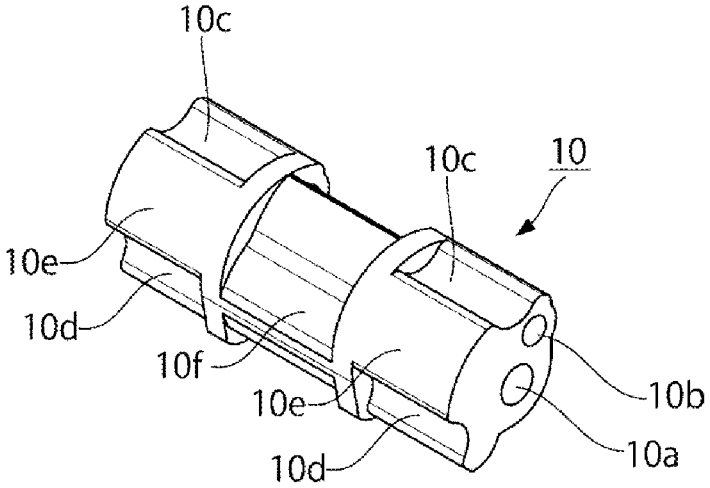
Figure 7C:
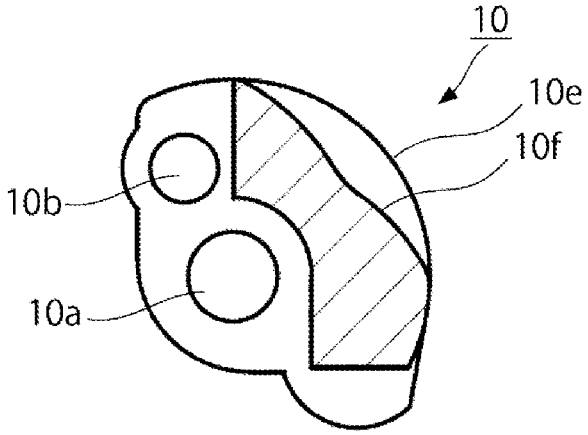

A rotation member 10 in the embodiment is made of synthetic resin such as POM, and structured, in particular as shown in FIG. 7, to rotate together with an opening and closing member 8, with a hinge shaft 9 as a fulcrum, by inserting the hinge shaft 9 into a hinge shaft attaching hole 10*a* provided as passing through in its axial direction and by passing a fixing pin 9*a* through a fixing hole 10*b* provided on its upper portion side. On the rotation member 10, first locking concave portions 10*c*, 10*c* are provided on a lower portion side on an outer circumference on their both end portions; second locking concave portions 10*d*, 10*d* are formed on its upper portion side, each of first cam portions 10*e*, 10*e* are formed between each of the first locking concave portions 10*c*, 10*c* and each of the second locking concave portions 10*d*, 10*d*, and a second cam portion 10*f* for a fluid damper 16, on its central portion.

Next, it is recommended to attach a cover member on the outside of an attaching member 5. This cover member can be also attached on the outside of an opening and closing member 8. Still further, expressions that both side plates, an attaching plate, a front plate, a rear plate, etc. are "bent" are used, however, in the embodiment as follows, if an attaching member 5, an opening and closing member 8, etc. are made of synthetic resin, there is no need for special efforts to bend these elements, but these can be just integrally formed from the beginning.

Next, reference is made to a rotation torque controlling mechanism A of an opening and closing member 8. In the embodiment, it comprises a rotation member 10 provided on the opening and closing member 8 side, a spring holder 11 and a slider 12, wherein both are housed inside an attaching member 5, main elastic members 13, 13 resiliently provided between the spring holder 11 and the slider 12, locking members 15, 15 provided between the attaching member 5 and the rotation member 10 via sub-elastic members 14, 14; still further, in the embodiment, the rotation torque controlling mechanism A comprises a locking mechanism A1 for locking the opening and closing member 8 at a predetermined opening and closing angle, a rotation torque adjusting mechanism A2 for adjusting a rotation torque of the opening and closing member 8 and a buffering mechanism A3.

Figure 5A:
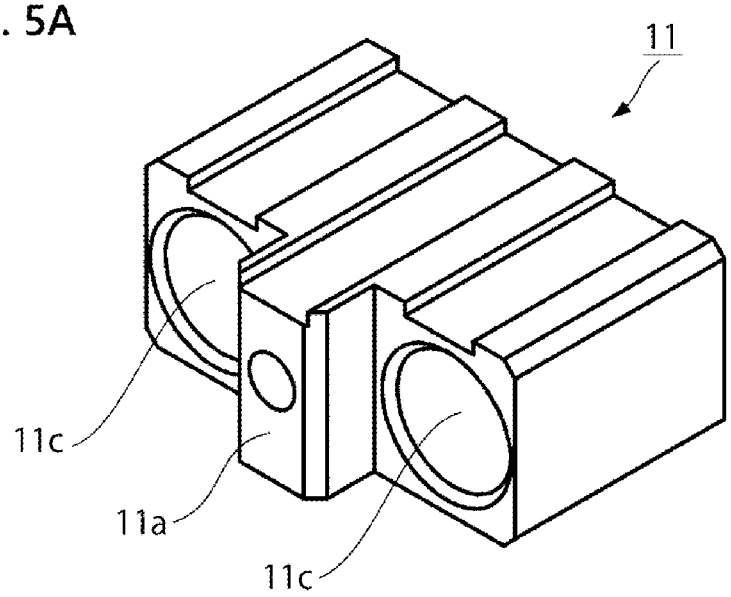
FIGS. 5A and 5B show a spring holder of an opening and closing device for opening and closing member according to the invention, FIG. 5A being its perspective view, as is seen from backward, and FIG. 5B—its cross section illustrating its interior structure.
Figure 5B:
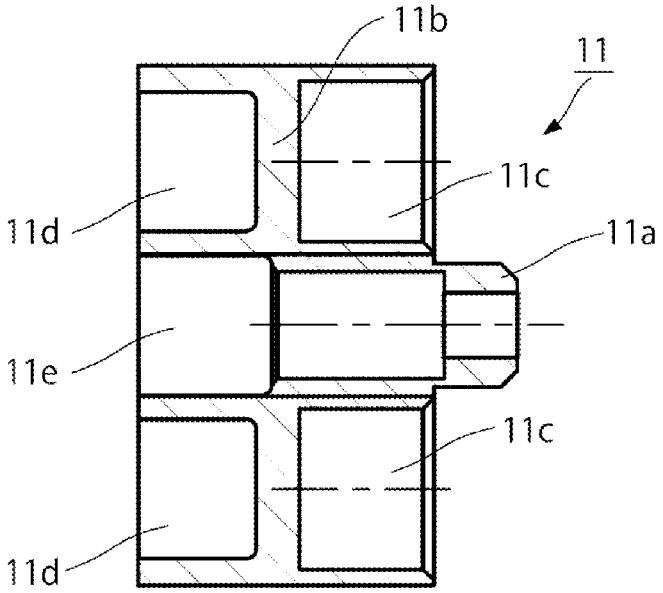
Figure 6A:
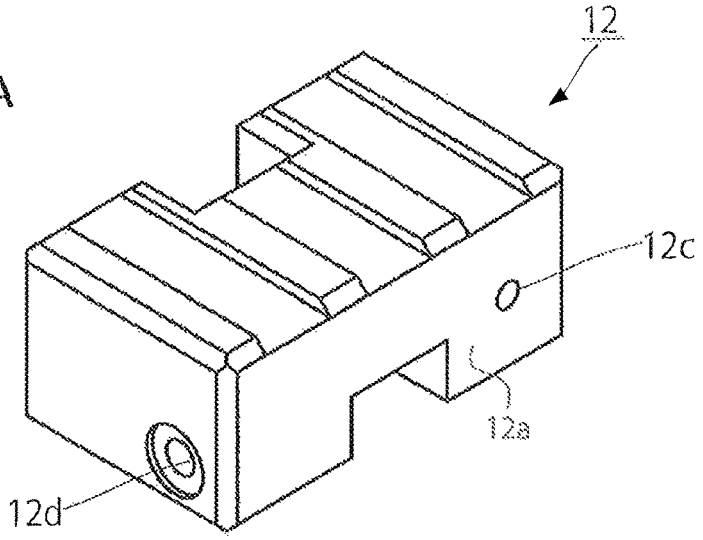
FIGS. 6A to 6C show a slider of an opening and closing device for opening and closing member according to the invention, FIG. 6A being its perspective view, as is seen from backward, FIG. 6B—its perspective view, as is seen from below, and FIG. 6C—its cross section illustrating its interior structure.
Figure 6B:
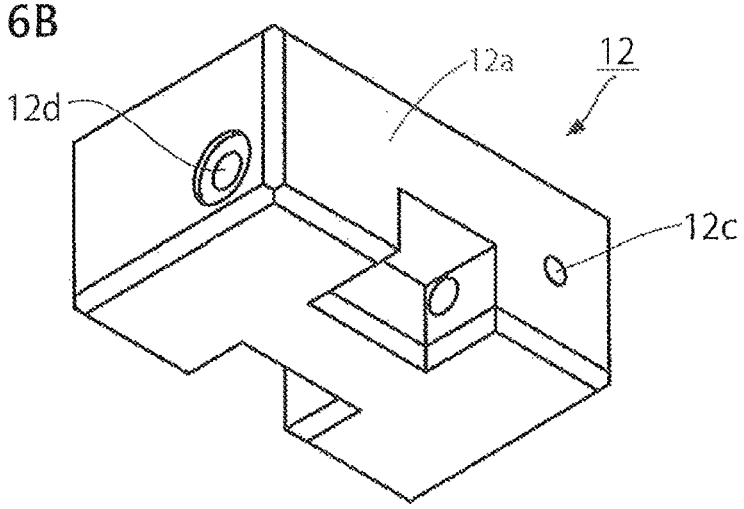
Figure 6C:
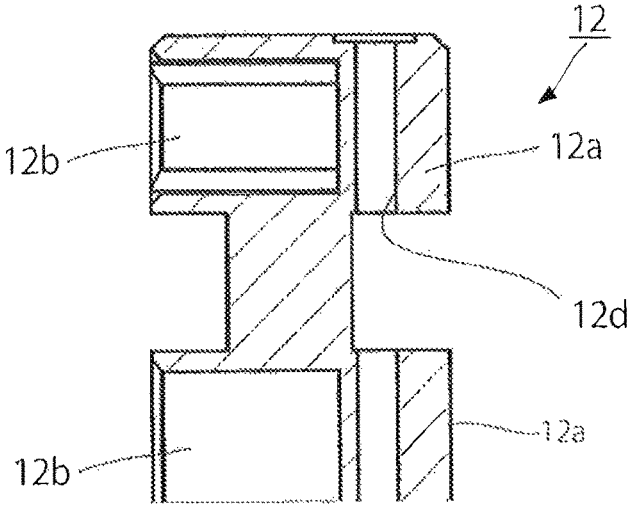

In particular as shown in FIG. 5, a spring holder 11 is housed inside an attaching member 5 on its front plate 5*d* side, and surrounded by a back plate 5*a*, both side plates 5*b*, 5*b* and a bottom plate 5*e* of the attaching member 5. Still further, in the spring holder 11, a convex portion 11*a* is provided on its one end portion side, as well as a partition wall 11*b* substantially on its central portion; a pair of first spring housing holes 11*c*, 11*c* are further formed on a slider 12 side, as well as a pair of locking member housing holes 11*d*, 11*d* on a side of a front plate 5*d* of an attaching member 5 are formed as separated by the partition wall 11*b*, with their respective ends being opened; furthermore, a damper housing hole 11*e* is provided on its central portion, without being separated by the partition wall 11*b*, with its end being opened on a side of a front plate 5*d* of an attaching member 5.

A slider 12 is slidably housed inside an attaching member 5 as opposed to a spring holder 11, and a pair of second spring housing holes 12*b*, 12*b*, respectively with a bottom portion 12*a*, are provided on it. On the slider 12, a screw inserting hole 12*c* for inserting an adjusting screw 17 through one of the second spring housing holes 12*b* in its slide direction is provided on its bottom portion 12*a*, and an insertion hole 12*d* for a second link shaft 20 is provided perpendicular to the slide direction. Main elastic members 13, 13 are both compression springs, and housed into each of first spring housing holes 11*c*, 11*c* of a spring holder 11 and each of second spring housing holes 12*b*, 12*b* of a slider 12.

Each of locking members 15, 15 is housed into each of locking member housing holes 11*d*, 11*d* of a spring holder 11, together with each of sub-elastic members 14, 14, both consisting e.g. of compression coil springs; after assembly, each of its convex portions 15*a*, 15*a* is structured to protrude from each of locking member insertion holes 5*h*, 5*h* provided on a front plate 5*d* of an attaching member 5 to be in pressurized contact with a rotation member 10. A convex portion 16*c* of a cap 16*b* placed over a piston rod 16*a* of a fluid damper 16 protrudes from a piston rod insertion hole 5*i* provided between locking member insertion holes 5*h*, 5*h* on a front plate 5*d* of an attaching member 5; it is also structured to be in pressurized contact with first cam portions 10*e*, 10*e* of the rotation member 10 at the time of assembly. In the meantime, the cap 16*b* is housed into a damper housing hole 11*e* provided on the spring holder 11.

A locking mechanism A1 of a rotation torque controlling mechanism A is composed of first locking concave portions 10*c*, 10*c* and second locking concave portions 10*d*, 10*d* provided at predetermined angular intervals on both end portion sides of a rotation member 10, as well as of locking members 15, 15 attached to a spring holder 11 by sub-elastic members 14, 14 so as to be slidable in one direction, wherein the locking members are fit into the first locking concave portions 10*c*, 10*c* and the second locking concave portions 10*d*, 10*d* at predetermined opening and closing angles of an opening and closing member 8.

Next, each of rotation torque adjusting mechanism A2 of a rotation torque controlling mechanism A is composed of an adjusting screw 17 provided on a side in which one main elastic member 13 is housed of a slider 12 toward one first spring housing hole 11*c*, a fixing plate 17*a* screwed onto the adjusting screw 17 within one second spring housing hole 12*b*, and a receiving seat portion 17*b* for receiving one end portion side of the main elastic member 13.

Then, a buffering mechanism A3 of a rotation torque controlling mechanism A is composed of a fluid damper 16 and a second cam portion 10*f* directed to a rotation member 10, it is structured to allow a convex portion 16*c* of a cap 16*b* as mentioned above to be in pressurized contact with the second cam portion 10*f*, starting from a predetermined angle of an opening and closing member 8.

In a description in the foregoing, a rotation torque controlling mechanism A comprises a rotation member 10, a spring holder 11, a slider 12, locking members 15, 15 slidably urged by sub-elastic members 14, 14 and thus housed in the spring holder 11, and main elastic members 13, 13 resiliently provided between the spring holder 11 and the slider 12; still further, it comprises a locking mechanism A1, rotation torque adjusting mechanism A2 and a buffering mechanism A3; however, all these components are optional, and without these, a rotation torque of an opening and closing member can be adjusted. In the simplest manner, it can be structured to comprise merely a rotation member 10 and a slider of a known structure (not shown) slidably urged by elastic members toward the rotation member 10 inside an attaching member 5. The invention meets requirements for novelty only by a combination of a rotation torque controlling mechanism A and a torque peak adjusting mechanism B in this simplest structure.

Figure 8:
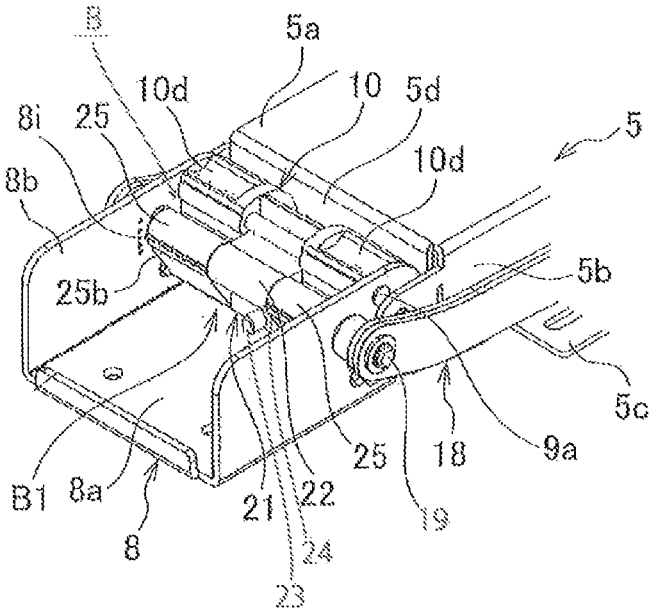
FIG. 8 shows an enlarged perspective view of a part of a torque peak adjusting mechanism of an opening and closing device for opening and closing member according to the invention.
Figure 9:
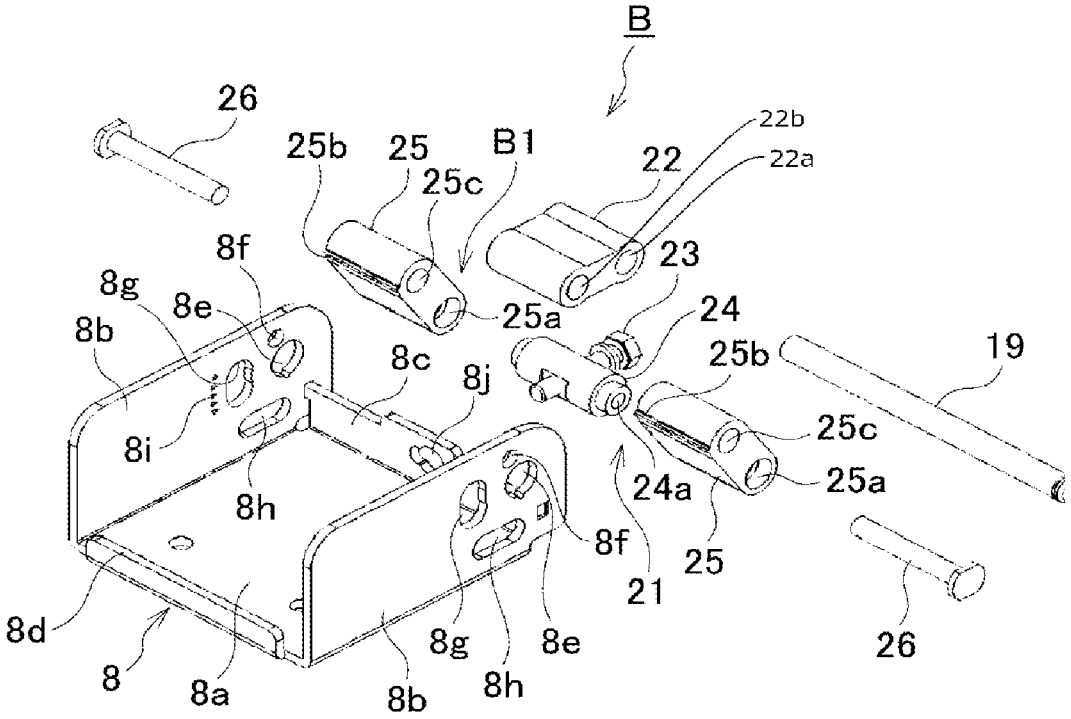
FIG. 9 shows an exploded perspective view of a part of a torque peak adjusting mechanism of an opening and closing device for opening and closing member according to the invention.
Figure 10A:
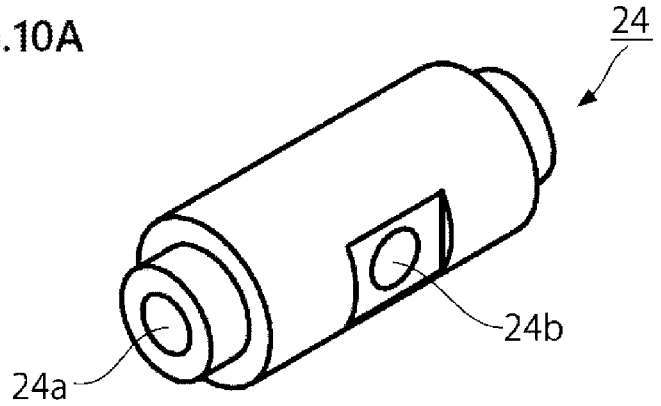
FIGS. 10A and 10B show a first member of a part of a torque peak adjusting mechanism of an opening and closing device for opening and closing member according to the invention, FIG. 10A being its perspective view, and FIG. 10B—its plan view.
Figure 10B:
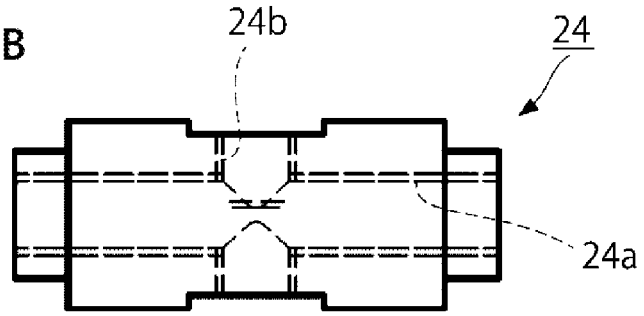
Figure 11A:
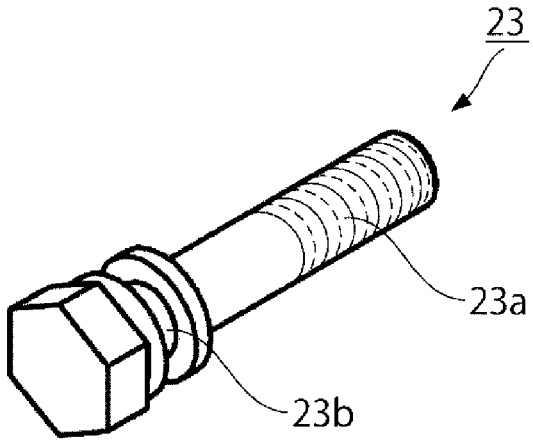
FIGS. 11A and 11B show an adjusting member of a part of a torque peak adjusting mechanism of an opening and closing device for opening and closing member according to the invention, FIG. 11A being its perspective view, and FIG. 11B—its plan view.
Figure 11B:
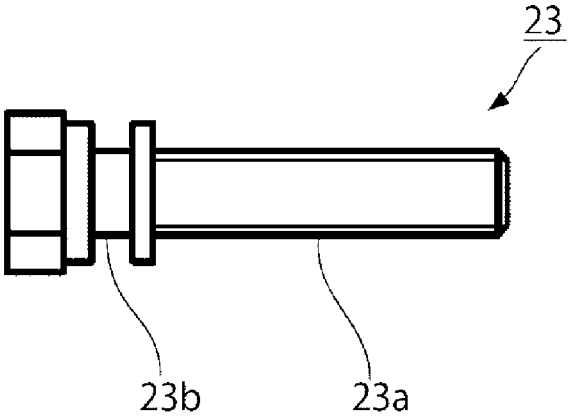
Figure 16A:
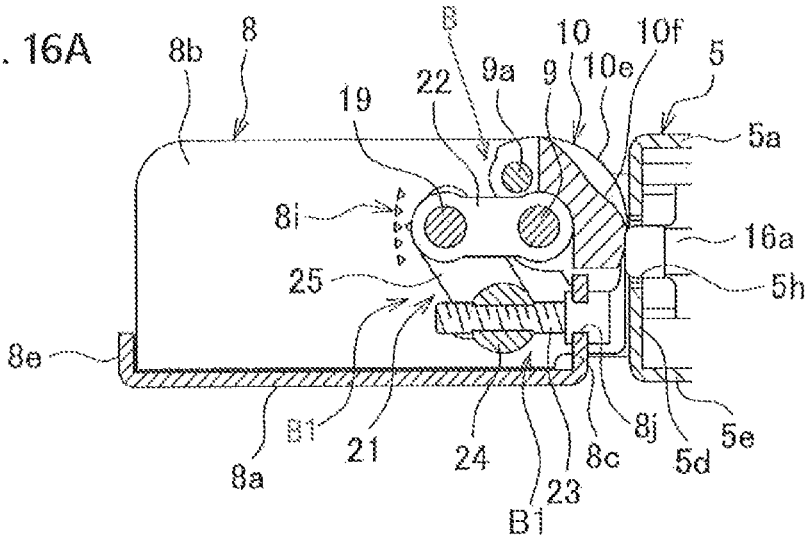
FIGS. 16A to 16C illustrate operation of a torque peak adjusting mechanism of an opening and closing device for opening and closing member according to the invention, FIG. 16A showing its state at a torque peak adjusting angle of 0 degree, FIG. 16B—its state at a torque peak adjusting angle adjusted to +10 degree, and FIG. 16C—its state at a torque peak adjusting angle adjusted to −10 degree.
Figure 16B:
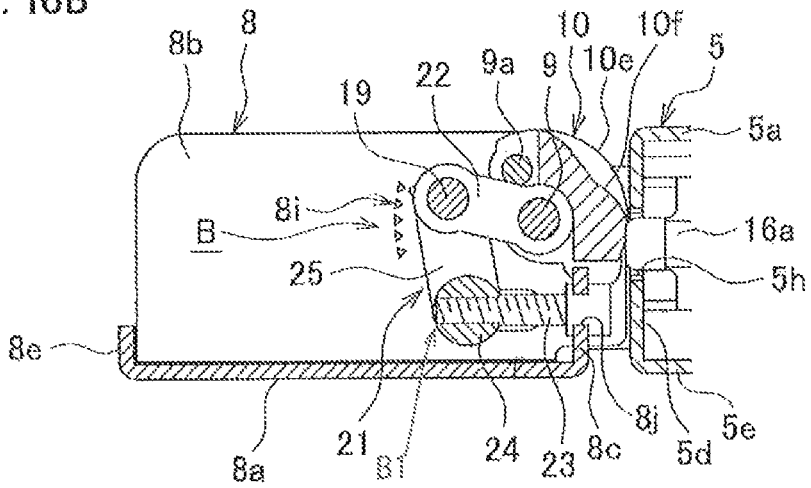
Figure 16C:
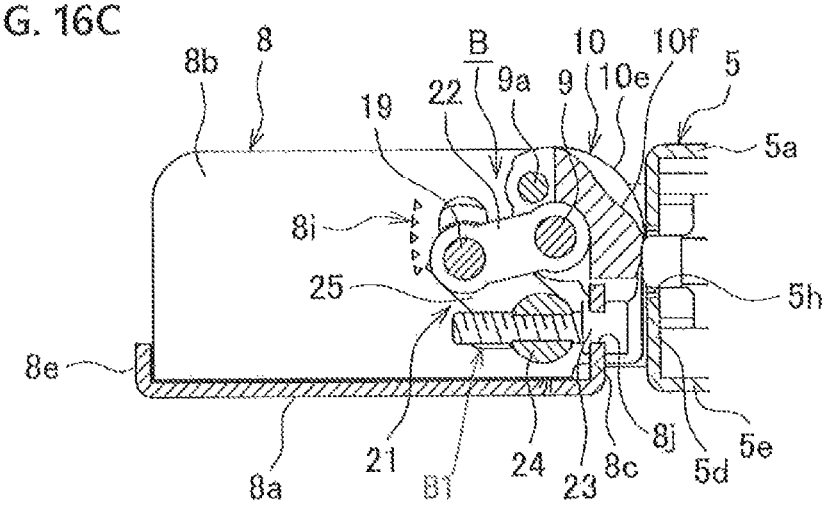

Next, reference is made to a torque peak adjusting mechanism B. Especially as shown in FIGS. 8, 9 and 16, the torque peak adjusting mechanism B comprises a first link member 21, wherein its one end portion arranged between both side plates 8*b*, 8*b* of an opening and closing member 8 is attached to the opening and closing member 8 so as to be slidable in a back and forth direction, and its other end portion is coupled to a first link shaft 19, a second link member 22, wherein its one end portion is coupled to a hinge shaft 9, and its other end portion is coupled to a first link shaft 19, and a position adjusting mechanism B1 for driving the first link member 21 to swing a second link shaft 20.

In the embodiment, a position adjusting mechanism B1 comprises a first link member 21, wherein both side portions on its one end portion side are coupled to slide pins 26, 26, and its other end portion is coupled to a first link shaft 19, a second link member 22, wherein a coupling hole 22*a* on its one end portion is coupled to a hinge shaft 9, and a coupling hole 22*b* on its other end portion is coupled to a first link shaft 19, and an adjusting member 23 rotatably attached to a screw attaching hole 8*j* provided on a rear plate 8*c* of an opening and closing member 8, wherein its male screw portion is screwed with the first link member 21. The first link member 21 comprises a first member 24, wherein coupling holes 24*a* are provided on its both end portions in an axial direction, and a female screw hole into which a male screw portion 23*a* of the adjusting member 23 is screwed, and a pair of second members 25, 25 arranged on both sides of the first member 24 and comprising through holes 25*a*, 25*b*; 25*a*, 25*b* arranged on the side of both side plates 8*b*, 8*b* of an opening and closing member 8 to pass through at an upper and lower positions in an axial direction; slide pins 26, 26 are attached so as to be slidable in back and forth direction relative to guide oblong holes 8*h*, 8*h* provided on both side plates 8*b*, 8*b* of the opening and closing member 8, to pass through through holes 25*a*, 25*a* provided on the second members 25, 25, so that the slide pins are inserted into the coupling hole 24*a* of the first member 24. In the embodiment, a screw attaching hole 8*j* provided on a rear plate 8*c* has a gourd shape by a combination of a small diameter portion and a large diameter portion, a neck portion 23*b* for engaging with the small diameter portion is provided on an adjusting member 23. In the meantime, the first member 24 and the second members 25, 25 can be also integrally formed in the first link member 21. Moreover, as per each of the second members 25, 25, a first link shaft passes through its through holes 25*b*, 25*b*, and pointed projection portions 25*c*, 25*c* are provided along with its axial direction and designed to point angle marks 8*i*, 8*i* provided on both side plates 8*b*, 8*b*.

Here, a hinge shaft 9, a first link shaft 19, a second hinge shaft 20, slide pins 26, 26, etc. comprise respective flange portions on their respective one end portions, through these are not shown well. The hinge shaft 9, the first link shaft 19, the second hinge shaft 20, a fixing pin 9*a*, etc. have their respective other end portion sides caulked, so as not to escape from their respective coupling positions in an axial direction. Otherwise, E-rings can be also used.

Figure 3:
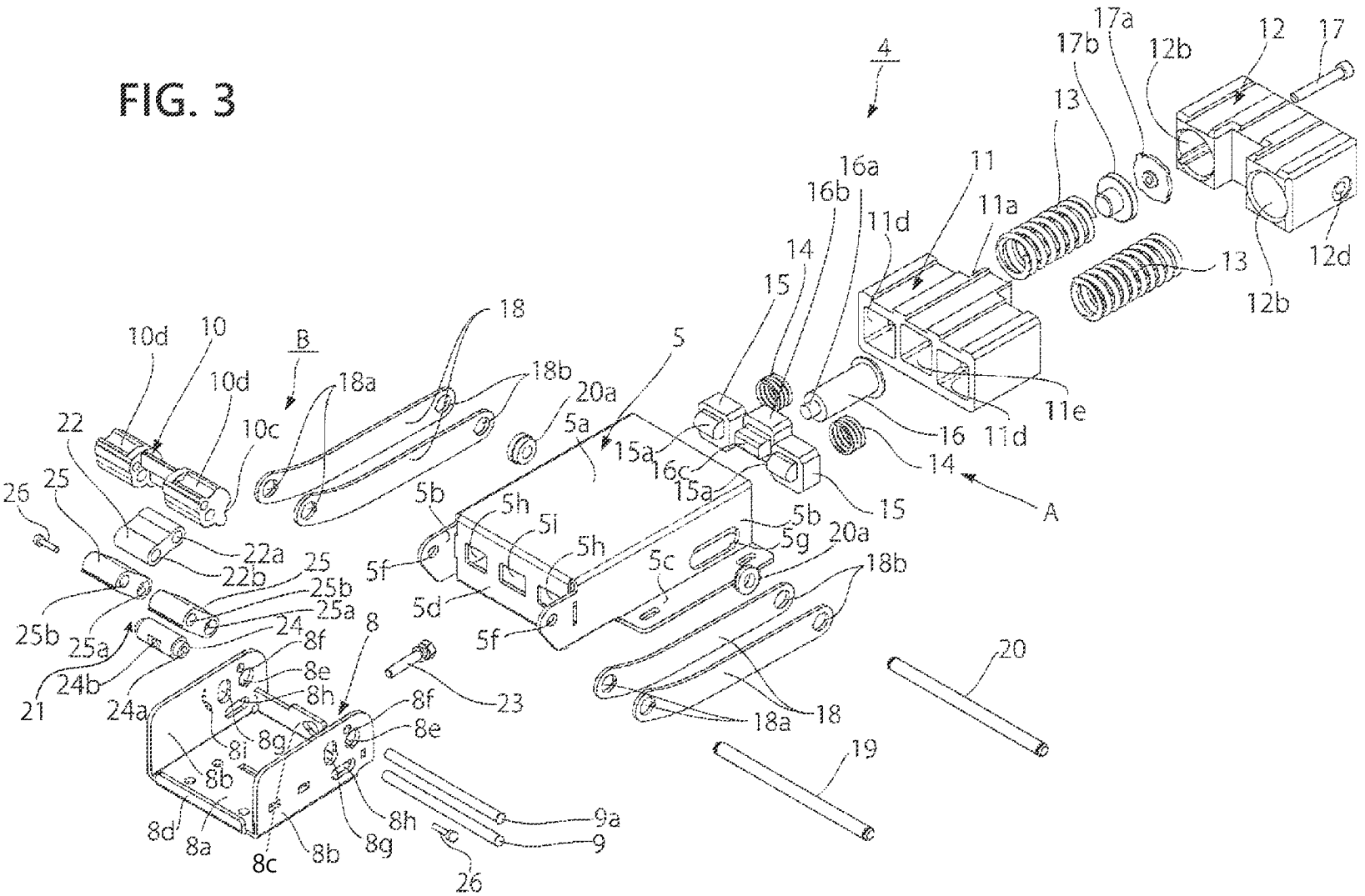
FIG. 3 shows an exploded perspective view of an opening and closing device for opening and closing member according to the invention.
Figure 4:
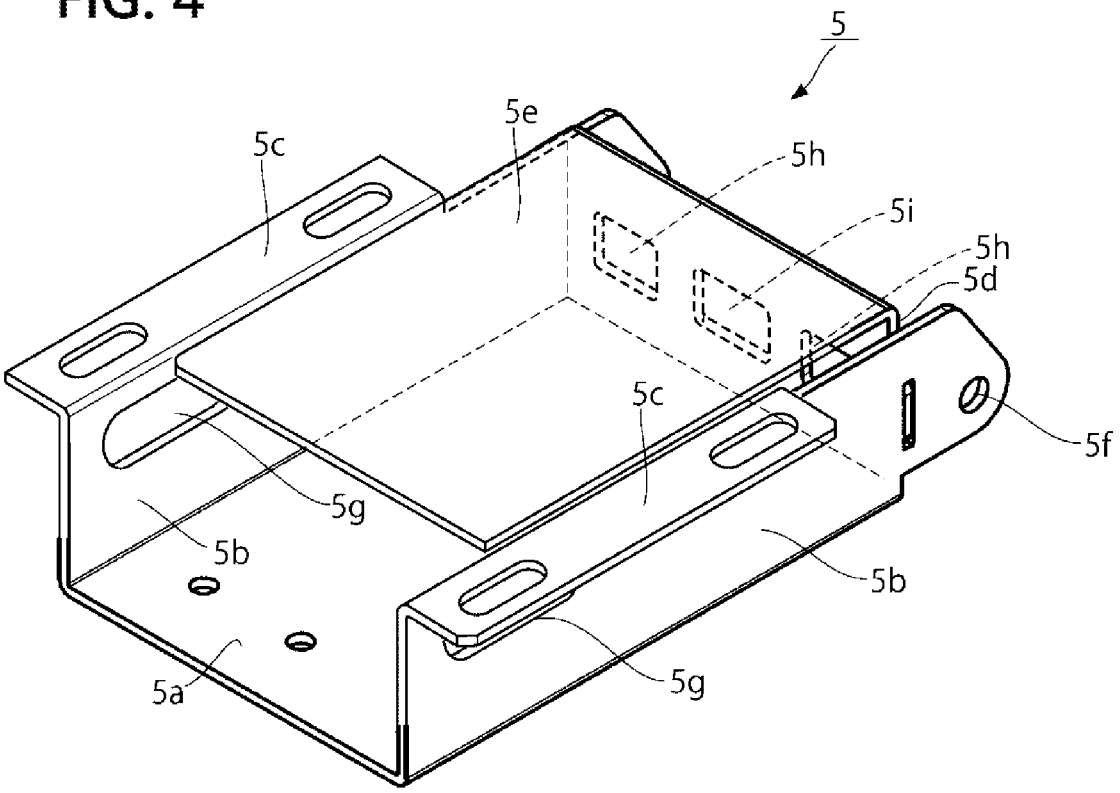
FIG. 4 shows a perspective view of an attaching member of an opening and closing device for opening and closing member according to the invention, as is seen from below.

In particular as shown in FIG. 3, each of link arms 18, 18 is composed of a pair of two belt-shaped objects, one overlapping another; it is arranged outside both side plates 5*b*, 5*b* of an attaching member 5; first coupling holes 18*a*, 18*a* provided on its one end portion are rotatably coupled to respective end portions of a first link shaft 19, and second coupling holes 18*b*, 18*b* provided on its other end portion are rotatably coupled to respective end portions of a second link shaft 20.

Figure 12A:
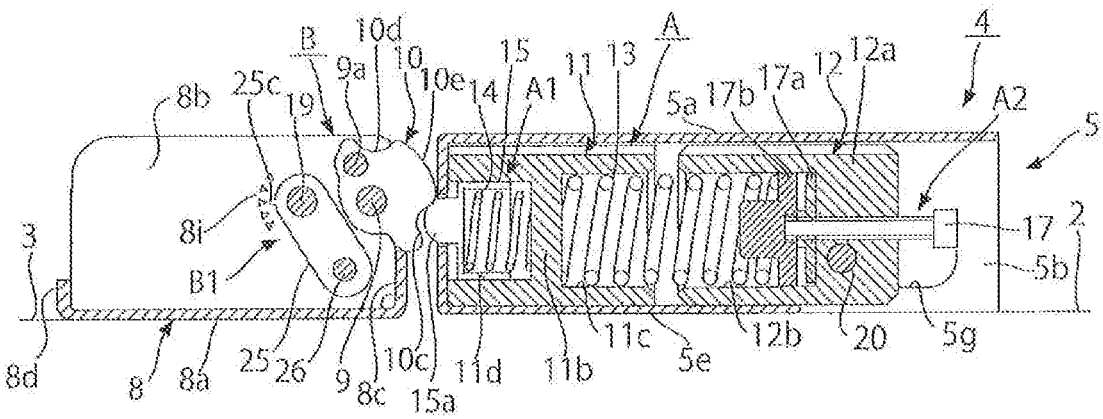
FIGS. 12A to 12C illustrate operation of an opening and closing device for opening and closing member according to the invention, at an opening and closing angle of 0 degree, at which an opening and closing member is closed relative to an opened and closed cabinet, FIG. 12A showing an area of main elastic members, FIG. 12B—an area of a fluid damper, and FIG. 12C—an area of a link arm.
Figure 12B:
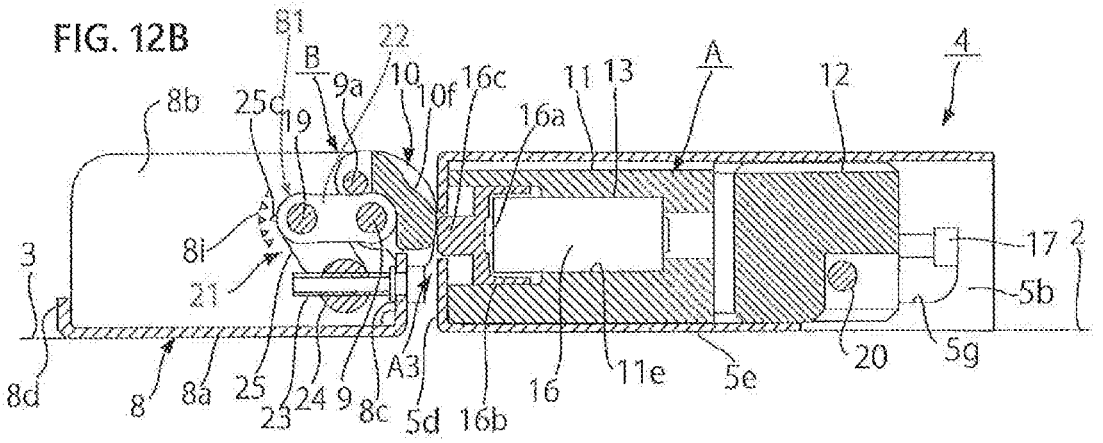
Figure 12C:
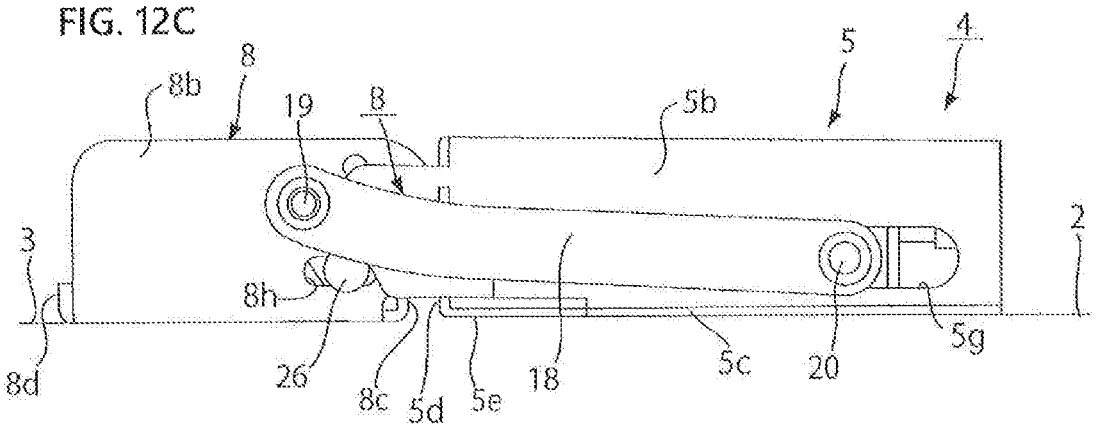

Next, reference is made to the operation and effect of the opening and closing device for opening and closing member 4 according to the invention, and first in particular to the rotation torque controlling mechanism A, with reference to FIGS. 12 to 15. FIG. 12 shows the state of the opening and closing angle of 0 degree, in which the opening and closing member 3 is closed relative to the opened and closed cabinet 2; in the state of the opening and closing angle of 0 degree, the main elastic members 13, 13 are pushed and compressed by the slider 12 pulled by the link arms 18, 18 toward the spring holder 11 side via the second link shaft 20, and the convex portions 15*a*, 15*a* of the locking members 15, 15 fall into the first locking concave portions 10*c*, 10*c* of the rotation member 10. Furthermore, the sub-elastic members 14, 14 pressurize the locking members 15, 15 toward the first locking concave portions 10*c*, 10*c* of the rotation member 10, so that the opening and closing member 3 is locked at this closing state and stably maintains the closing state. Still further, the convex portion 16*c* of the cap 16*b* attached to the piston rod 16*a* of the fluid damper 16, which protrudes from the piston rod insertion hole 5*i* provided on the front plate 5*d* of the attaching member 5, is in pressurized contact with the second cam portion 10*f* provided on the outer circumference of the rotation member 10.

Figure 13A:
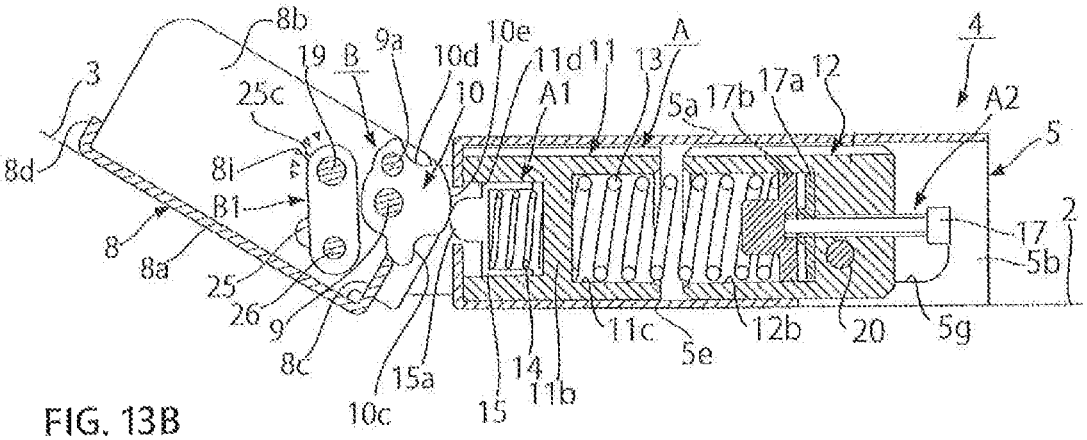
FIGS. 13A to 13C illustrate operation of an opening and closing device for opening and closing member according to the invention, showing a state in which an opening and closing member is opened 30 degrees relative to an opened and closed cabinet from a state shown in FIG. 12, FIG. 13A showing an area of main elastic members, FIG. 13B—an area of a fluid damper, and FIG. 13C—an area of a link arm.
Figure 13B:
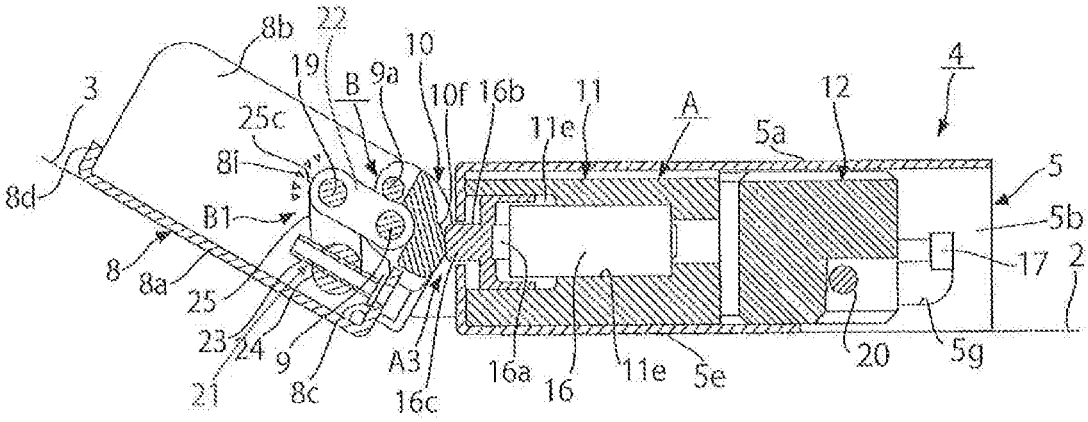
Figure 13C:
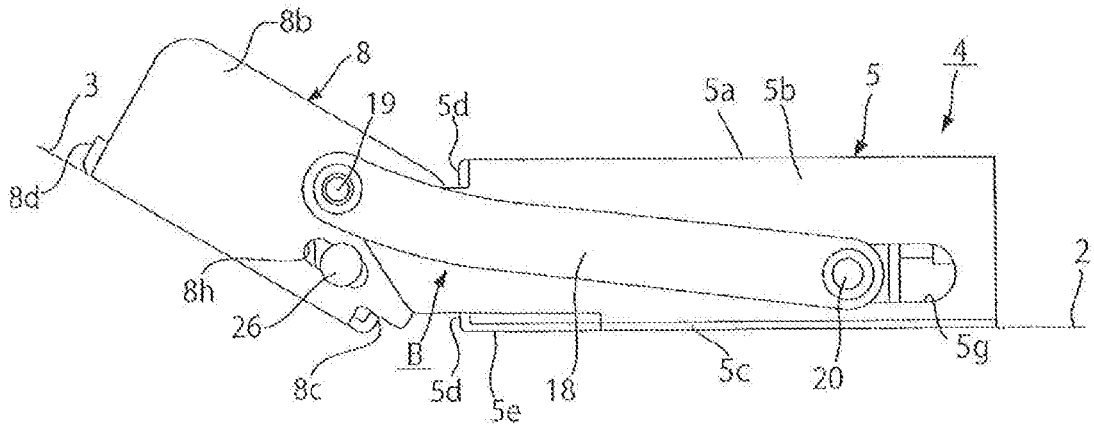

FIG. 13 shows the state of the opening and closing member 3 opened 30 degrees from the state of the opening and closing angle of 0 degree, as shown in FIG. 12. In this state, the opening and closing member 8 rotates clockwise, and the convex portions 15*a*, 15*a* of the locking members 15, 15 are released from the first locking concave portions 10*c*, 10*c* of the rotation member 10, being in pressurized contact with the first cam portions 10*e*, 10*e* on the outer circumference of the rotation member 10, and the opening and closing member 8 is urged to rotate upward in the opening direction, so that the opening and closing member 3 can be smoothly opened without giving a feel of its own weight.

Figure 14A:
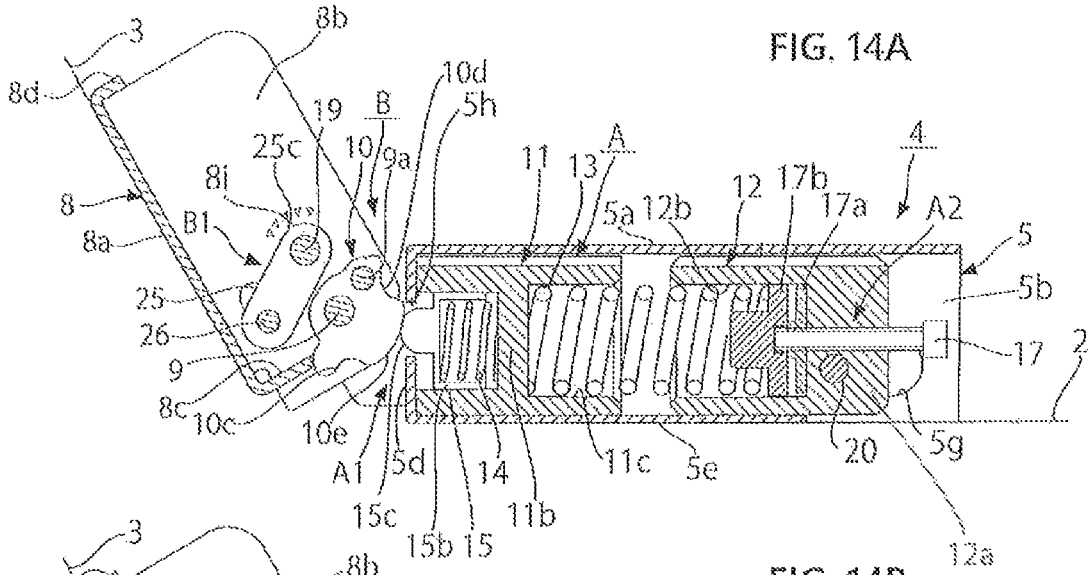
FIGS. 14A to 14C illustrate operation of an opening and closing device for opening and closing member according to the invention, showing a state in which an opening and closing member is opened 60 degrees relative to an opened and closed cabinet from a state shown in FIG. 12, FIG. 14A showing an area of main elastic members, FIG. 14B—an area of a fluid damper, and FIG. 14C—an area of a link arm.
Figure 14B:
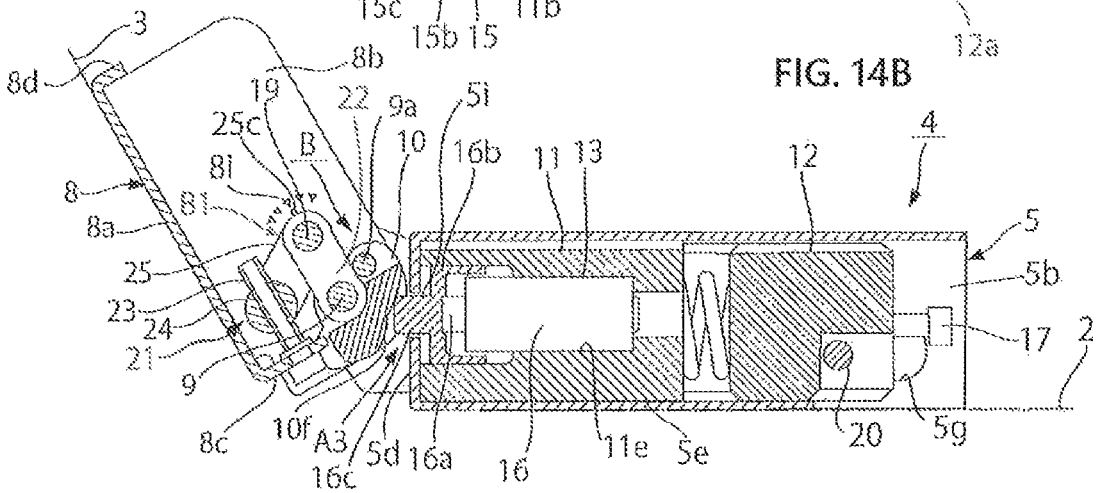
Figure 14C:
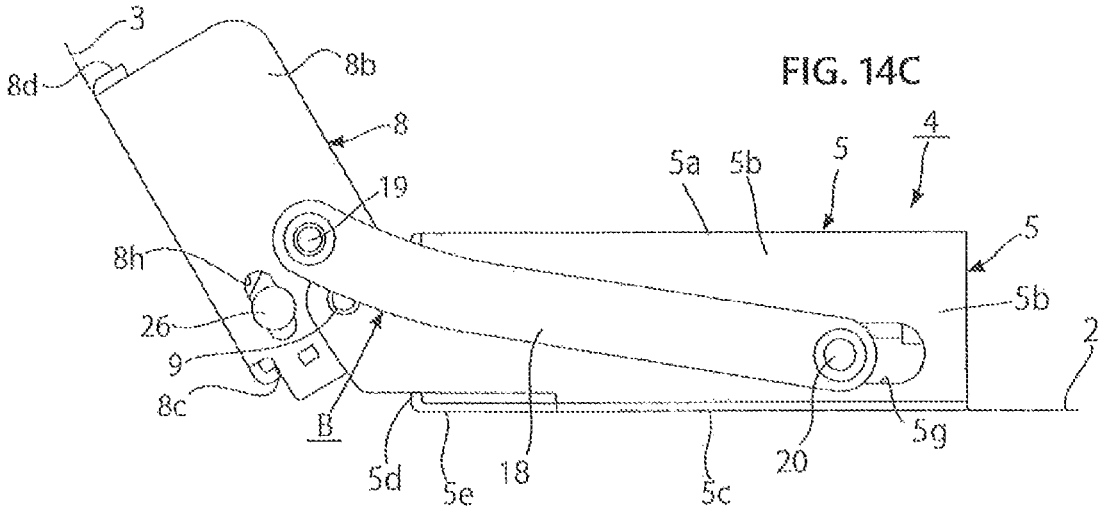

FIG. 14 shows the state of the opening and closing member 3 opened 60 degrees from the state shown in FIG. 12; in this state, the opening and closing member 3 is in pressurized contact with the first cam portions 10*e*, 10*e* of the rotation member 10, so that it can maintain the opening angle of 60 degrees, without automatically falling.

Figure 15A:
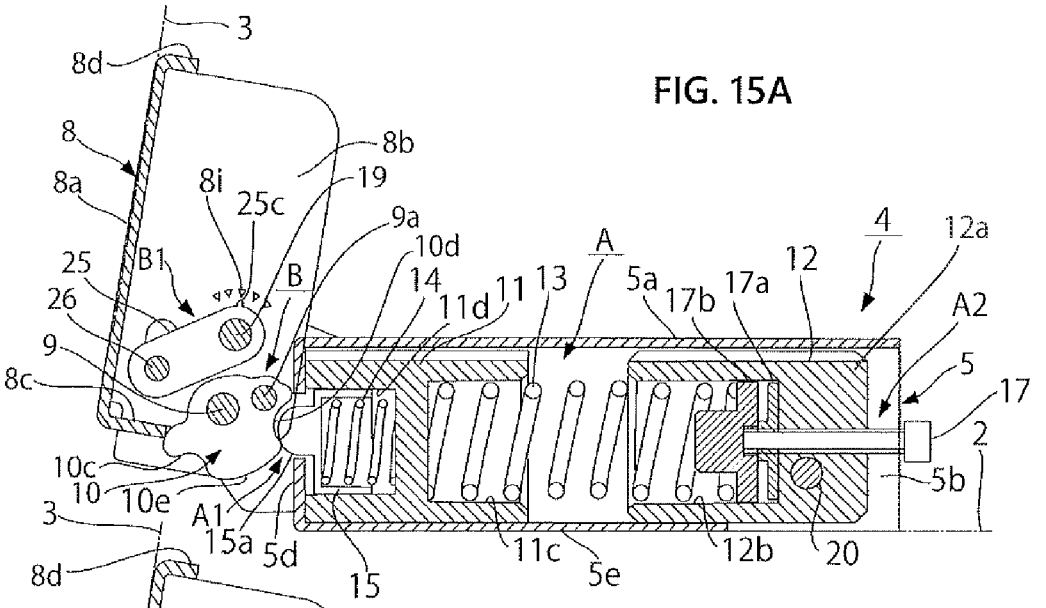
FIGS. 15A to 15C illustrate operation of an opening and closing device for opening and closing member according to the invention, showing a state in which an opening and closing member is opened 100 degrees relative to an opened and closed cabinet from a state shown in FIG. 12, FIG. 15A showing an area of a main elastic member, FIG. 15B—an area of a fluid damper, and FIG. 15C—an area of a link arm.
Figure 15B:
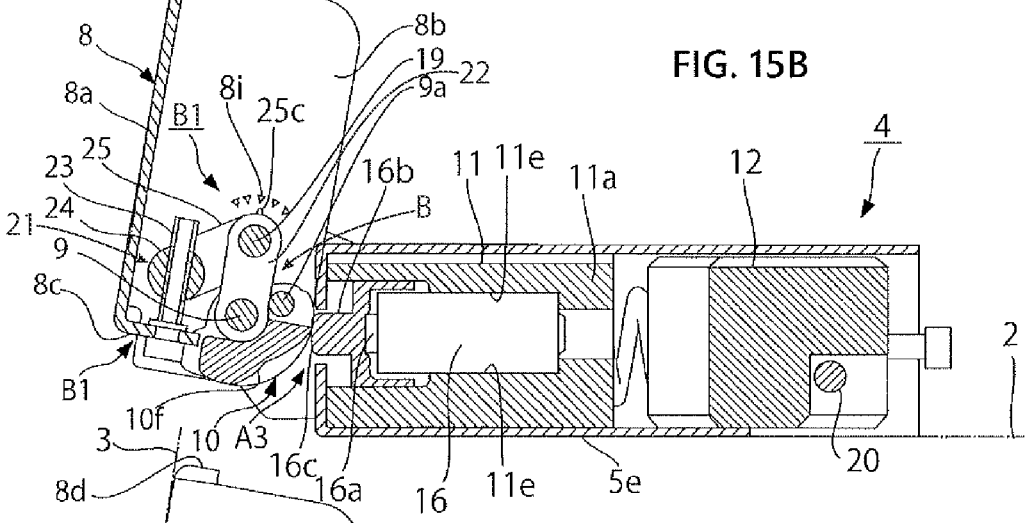
Figure 15C:
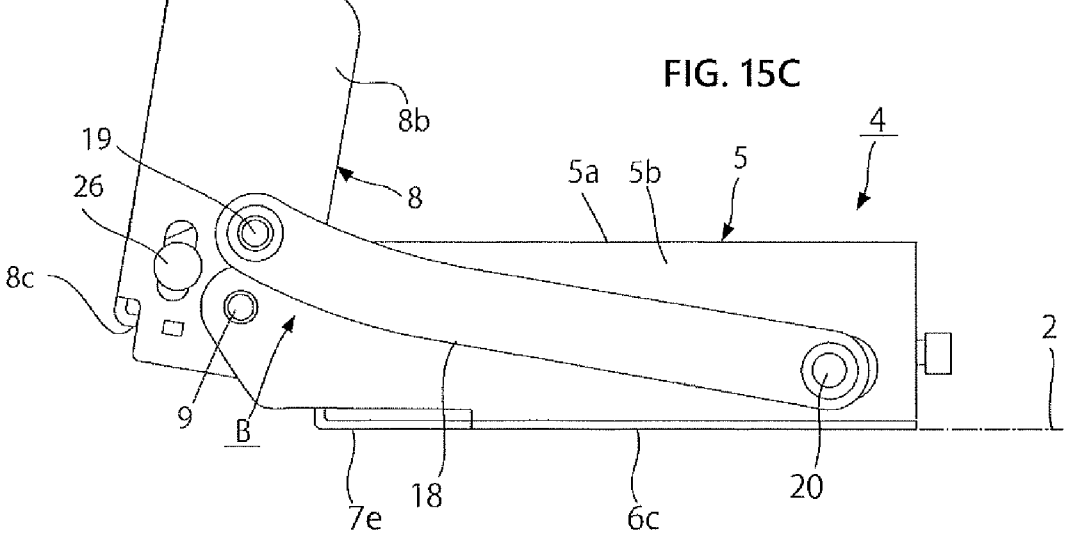

FIG. 15 shows the state of the opening and closing member 3 opened 100 degrees from the state shown in FIG. 12; at this opening angle of 100 degrees, the convex portions 15*a*, 15*a* of the locking members 15, 15 fall into the second locking concave portions 10*d*, 10*d* of the rotation member 10, and the sub-elastic members 14, 14 pressurize the convex portions 15*a*, 15*a* of the locking members 15, 15 into the second locking concave portions 10*d*, 10*d*, so that the opening and closing member 3 is stably held at this opening angle of 100 degrees and does not easily fall to close, even in case of vibration or shaking of the opened and closed cabinet 2.

Next, when the opening and closing member 3 once opened up is closed, the convex portions 15*a*, 15*a* of the locking members 15, 15 are released from the second locking concave portions 10*d*, 10*d* of the rotation member 10, and the opening and closing member 8 rotates counter-clockwise as is shown in the drawings, in pressurized contact with the first cam portions 10*e*, 10*e* of the rotation member 10, so that the opening and closing member 3 is closed. Once the opening and closing member 3 reaches the predetermined closing angle, the second cam portion 10*f* of the rotation member 10 is in pressurized contact with the convex portion 16*c* of the cap 16*b* of the fluid damper 16, which thus prevents the opening and closing member 3 from suddenly falling, so that it is calmly closed.

As shown in FIG. 12, in the closed opening and closing member 3, the convex portions 15*a*, 15*a* of the locking members 15, 15 fall into the first locking concave portions 10*c*, 10*c* of the rotation member 10, so that the opening and closing member 3 stably maintains its closed state.

Next, the torque peak of the opening and closing member 3 is adjusted by the torque peak adjusting mechanism B, through the rotation of the adjusting member 23 either to the right or left. Namely, as shown in FIG. 16, the pointed projection portions 25*c*, 25*c* of the second members 25, 25 point the one in the middle among the angle marks 8*i*, 8*i* at the opening and closing angle of 0 of the opening and closing member 8, thus in the closed state of the opening and closing member 3. When the adjusting member 23 is rotated from this state either to the right or left, the first member 24 of the first link member 21 is guided by the slide pins 26, 26 to slide in back and forth direction of the opening and closing member 8 relative to the opening and closing member. Then, the first link shaft 19 is guided through the second members 25, 25 inside the guide long holes 8*g*, 8*g* provided on the both side plates 8*b*, 8*b* of the opening and closing member 8 to rotate in upward and downward direction, with the second link shaft 20 as a fulcrum. Thereupon, the position of starting the opening operation of the opening and closing member 3 from its opening angle of 0 degree via the opening and closing member 8 is shifted; here, provided that the torque peak for the hinge torque of the opening and closing device for opening and closing member 4 is set at the torque peak of 60 degrees when the pointed projection portions point 0 degree, i.e. the one in the middle among the angle marks 8*i*, 8*i*, when the first link shaft 19 lies below the guide long holes 8*g*, 8*g* of the opening and closing member 8, the torque peak is shifted upward as compared to the reference situation. When the first link shaft 19 lies above the guide long holes 8*g*, 8*g*, the torque peak is shifted downward as compared to the reference situation.

Figure 17:
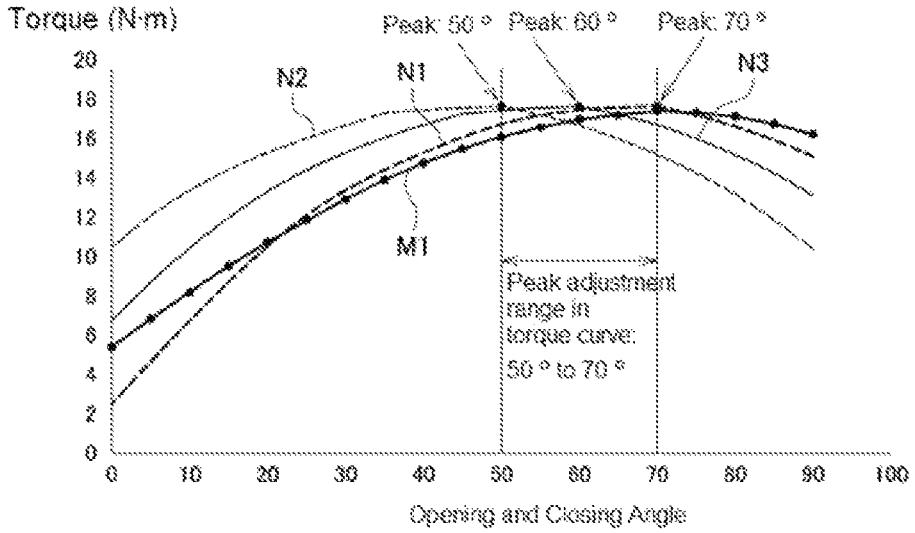
FIG. 17 shows a graphical representation for showing an interrelation between a hinge torque curve of an opening and closing device for opening and closing member according to the invention and a moment curve of the opening and closing member.

The embodiment is structured such that, if the torque peak defaults to 60 degrees, as shown in FIG. 16, the torque peak can be adjusted between 50 degrees, i.e. −10 degrees and 70 degrees, i.e. +10 degrees. According to FIG. 17, the curve denoted with M1 herein represents the moment curve for the opening and closing member 3, while the one denoted with N1 represents the reference torque curve for the opening and closing device for opening and closing member 4. According to the drawing, the torque peak in this case is 60 degrees. The curve N2 represents the case that the first link shaft 19 lies below the guide long holes 8*g*, 8*g* of the opening and closing member 8, and in this case, the torque peak is 50 degrees; the curve N3 represents the torque curve, where the first link shaft 19 lies above the guide long holes 8*g*, 8*g* of the opening and closing member 8, and in this case, the torque peak is 70 degrees. In this manner, the torque peak for the opening and closing device for opening and closing member 4 according to the invention can be adjusted between 50 degrees and 70 degrees.

Next, reference is made to the operation of the locking mechanism A1. The locking mechanism A1 is composed of the first locking concave portions 10*c*, 10*c* and the second locking concave portions 10*d*, 10*d* provided on the rotation member 10, as well as of the locking members 15, 15 and the sub-elastic members 14, 14 slidably provided in the spring holder 11; in the embodiment, the convex portions 15*a*, 15*a* of the locking members 15, 15 respectively protruding from the locking member insertion holes 5*h*, 5*h* are fitted into the first locking concave portions 10*c*, 10*c* at the opening and closing angle of 0 degree of the opening and closing member 8, and the opening and closing member 8 is locked at its opening and closing angle of 0 degree; furthermore, the convex portions 15*a*, 15*a* of the locking members 15, 15 are fitted into and locked to the second locking concave portions 10*d*, 10*d* at the opening and closing angle of 100 degrees, and stably held at the opening and closing angle of 100 degrees. In the meantime, the installation positions and the number of the first locking concave portions 10*c*, 10*c* and the second locking concave portions 10*d*, 10*d* are not limited to those in the Embodiment. They can be modified, or increased or decreased, as is necessary.

Next, reference is made to the operation of the rotation torque adjusting mechanism A2; the adjusting screw 17 provided on a side of one main elastic member 13 is rotated either to the right or left, so that the receiving seat portion 17*b* is shifted in the axial direction of the adjusting screw 17; in this manner, the elastic force of the main elastic member 13 fluctuates, so that the rotation torque of the opening and closing member 8 can be adjusted.

The buffering mechanism A3 consists of the fluid damper 16; when the opening and closing member 3 is closed and the opening and closing member 8 reaches the predetermined closing angle from the opened state, the convex portion 16*c* of the cap 16*b* protruding from a piston rod insertion hole 5*i* provided on the front plate 5*d* of the attaching member 5 is in pressurized contact with the second cam portion 10*f* provided on the rotation member 10, so that the brake is applied and the opening and closing member 3 attached to the opening and closing member 8 is calmly closed, without suddenly closing.

Other embodiments may include, though not shown, the one with a hinge shaft separated into two being respectively coupled to each of both side plates 8*b*, 8*b* on the opening and closing member 8 side and to each of both side plates 5*b*, 5*b* of the attaching member 5.

Since the invention is constructed as described in the foregoing, an opening and closing device for opening and closing member according to the invention is in particular used to openably and closably attach the opening and closing member to an opened and closed cabinet such as a piece of furniture, so that it allows the opening and closing member to open and close without giving a feel of its own weight, to maintain a predetermined intermediate opening angle and to stably hold its stop at a fully closed and a fully opened state. Furthermore, it is suitably used as an opening and closing device for opening and closing member for allowing for a buffering function of preventing the opening and closing member from suddenly closing during a closing operation, thus enabling an adjustment of a torque peak and a rotation torque, and also as various opened and closed bodies using such an opening and closing device for opening and closing member.

What is claimed is:

1. A hinge device, comprising:

an attaching member having a back plate, two side plates attached to the back plate, attaching plates protruding outwardly from each side plate, and a front plate protruding from the back plate, and a bottom plate protruding from the back plate opposite the front plate;

an opening and closing member (8) comprising an attaching plate, two side plates protruding from the attaching plate, a rear plate protruding from a rear end of the attaching plate, a front plate protruding from a front end of the attaching plate, a hinge shaft (9) rotatably attaching the side plates of the opening and closing member (8) to the side plates of the attaching member;

a rotation torque controlling mechanism (A) comprising a rotation member (10) having a pair of first cam portions (10*e*, 10*e*) on both side portions and attached by the hinge shaft (9) and a fixing pin (9*a*) between both side plates (8*b*, 8*b*) of said opening and closing member (8), a spring holder (11) and a slider (12), both housed inside said attaching member (5), main elastic members (13, 13) provided between the spring holder (4) and said slider (12), locking members (15, 15) provided between said attaching member (5) and said rotation member 10 via sub-elastic members (14, 14), the locking member having two convex portions (15*a*, 15*a*), which are in pressure contact with said rotating member (10) via locking member insertion holes (5*h*, 5*h*) provided in the front plate (5*d*) of said attaching member (5), and said slider (12) is attached to a second link shaft (20) through guide elongated holes (5*h*, 5*h*) provided on both side plates (5*b*, 5*b*) of said attaching member (5);

and a torque peak adjusting mechanism (B) comprising a pair of second members (25, 25) located between the side walls of the opening and closing member (8), one end of the pair of second members (25, 25) is slidably attached to the opening and closing member (8), an opposite end coupled to a first link shaft (19), and a second link member (22), one end coupled to the hinge shaft (9), an opposite end coupled to the first link shaft (19).

2. The hinge device according to claim 1, further comprising a rotation torque adjusting means comprising an adjusting screw (17) through said back plate (5*a*) of the attaching member (5) and engaging a fixing plate (17*a*) attached to said slider (12).

3. The hinge device according to claim 1, further comprising a buffering means composed of a fluid damper (16) provided in said spring holder (11), the fluid damper (16) engages a cap (16*b*) with a convex portion (16*c*) which protrudes through a piston rod insertion hole (5*i*) of the front plate (5*d*) to be in pressurized contact with the second cam portion (10*f*) of the rotation member (10).

* * * * *